US006676500B1

(12) United States Patent
Lin

(10) Patent No.: US 6,676,500 B1
(45) Date of Patent: Jan. 13, 2004

(54) DRILL BIT SHARPENER

(76) Inventor: Sophin Lin, No. 2, Lane 177, Sec. 2, Jen-Ai Rd., Tan-Tze Hsiang, Taichung Hsien (TW)

( * ) Notice: Subject to any disclaimer, the term of this patent is extended or adjusted under 35 U.S.C. 154(b) by 0 days.

(21) Appl. No.: 10/292,676

(22) Filed: Nov. 12, 2002

(51) Int. Cl.[7] ..... B24B 27/08

(52) U.S. Cl. ..... 451/359; 451/48; 451/282; 451/267; 451/259; 451/349; 451/549; 76/108.6; 76/82; 30/457

(58) Field of Search ..... 451/48, 282, 267, 451/259, 359, 375, 349, 549; 76/108.6, 82; 30/457

(56) References Cited

U.S. PATENT DOCUMENTS 3,803,771 A * 4/1974 Bunn ..... 451/359
4,031,672 A * 6/1977 Moores et al. ..... 451/48
4,069,619 A * 1/1978 Escamilla ..... 451/65
4,858,389 A * 8/1989 Wurscher ..... 451/241
4,974,372 A * 12/1990 Chantalat ..... 451/48
5,210,977 A * 5/1993 Werner ..... 451/283
5,400,546 A * 3/1995 Christian et al. ..... 451/143
5,676,591 A * 10/1997 Huang ..... 451/359
5,735,732 A * 4/1998 Bernard ..... 451/242
6,116,995 A * 9/2000 Chao ..... 451/351
6,249,981 B1 * 6/2001 Shu ..... 30/457

* cited by examiner

*Primary Examiner*—George Nguyen
(74) *Attorney, Agent, or Firm*—Alan D. Kamrath; Rider Bennett, LLP

(57) ABSTRACT

A drill bit sharpener includes a motor assembly and a drill bit grinding assembly. The motor assembly has a motor with a drive shaft to drive the drill bit grinding assembly, which includes a driven assembly, a sharpener housing, a grinding wheel assembly and a bit guide assembly. The sharpener housing is attached to the motor assembly, and the grinding wheel assembly is rotatably mounted in the sharpener housing and is rotated by the driven assembly. The bit guide assembly is mounted in the sharpener housing above the grinding wheel assembly. An adjusting screw in the bit guide assembly is used to adjust the grinding wheel assembly relative to the bit guide assembly. Multiple bit guide holes correspond to the grinding wheel assembly are defined in the bit guide assembly and allow a drill bit to pass through to abut the grinding wheel.

13 Claims, 5 Drawing Sheets

DRILL BIT SHARPENER

BACKGROUND OF THE INVENTION

1. Field of the Invention

The present invention relates to a drill bit sharpener, and more particularly to a drill bit sharpener having a rotating grinding wheel with an adjustable position to sharpen drill bits, which can be assembled quickly.

2. Description of Related Art

Drilling machines and drills make holes in objects. A drill has a drill bit that is turned to make the hole in the object. A cutting edge with a relief angle is formed on one end of the drill bit. After an extensive use, the cutting edge and the relief angle of the drill bit will become dull or break. A user must replace the dull or broken drill bit with a new drill bit to keep making holes efficiently, but replacement of the drill bits is not economical.

To sharpen a dull or broken drill bit is more economical than throwing the drill bit away. A conventional bench grinder with a rotating grinding wheel is often used to sharpen drill bits. The user holds the drill bit in his or her hands and uses the rotating grinding wheel to grind a cutting edge with the appropriate relief angle on the drill bit. Using a conventional bench grinder to sharpen drill bits has some shortcomings in both operating and using. The shortcomings include the following.

1. Inconvenience operation:

Bench grinders are big and occupy a big space. The bench grinder must be mounted in a location before it can be used. The bench grinder is not easy to carry and not portable. Furthermore, holding the drill bit at the proper angle against the grinding wheel to accurately the tip is not easy. A user often much time to grind proper shape and angle on the drill bit.

2. Hazardous operation:

The grinding wheel rotates at a very high speed, and at least part of the grinding wheel is exposed to surrounding environment. The user holds the drill bit in his or her hands and may inadvertently touch the grinding wheel if he.or she is the least bit careless. The high-speed, grinding wheel will injure the user if the user touches the wheel.

To overcome the shortcomings, the present invention provides a drill bit sharpener to mitigate or obviate the aforementioned problems.

SUMMARY OF THE INVENTION

The main objective of the invention is to provide a drill bit sharpener that will sharpen drill bits easily, quickly and efficiently.

Another objective of the invention is to provide a drill bit sharpener that is portable so a user can carry the sharpener and use it on the work site.

Other objectives, advantages and novel features of the invention will become more apparent from the following detailed description when taken in conjunction with the accompanying drawings.

DETAILED DESCRIPTION OF PREFERRED EMBODIMENT

Figure 1:
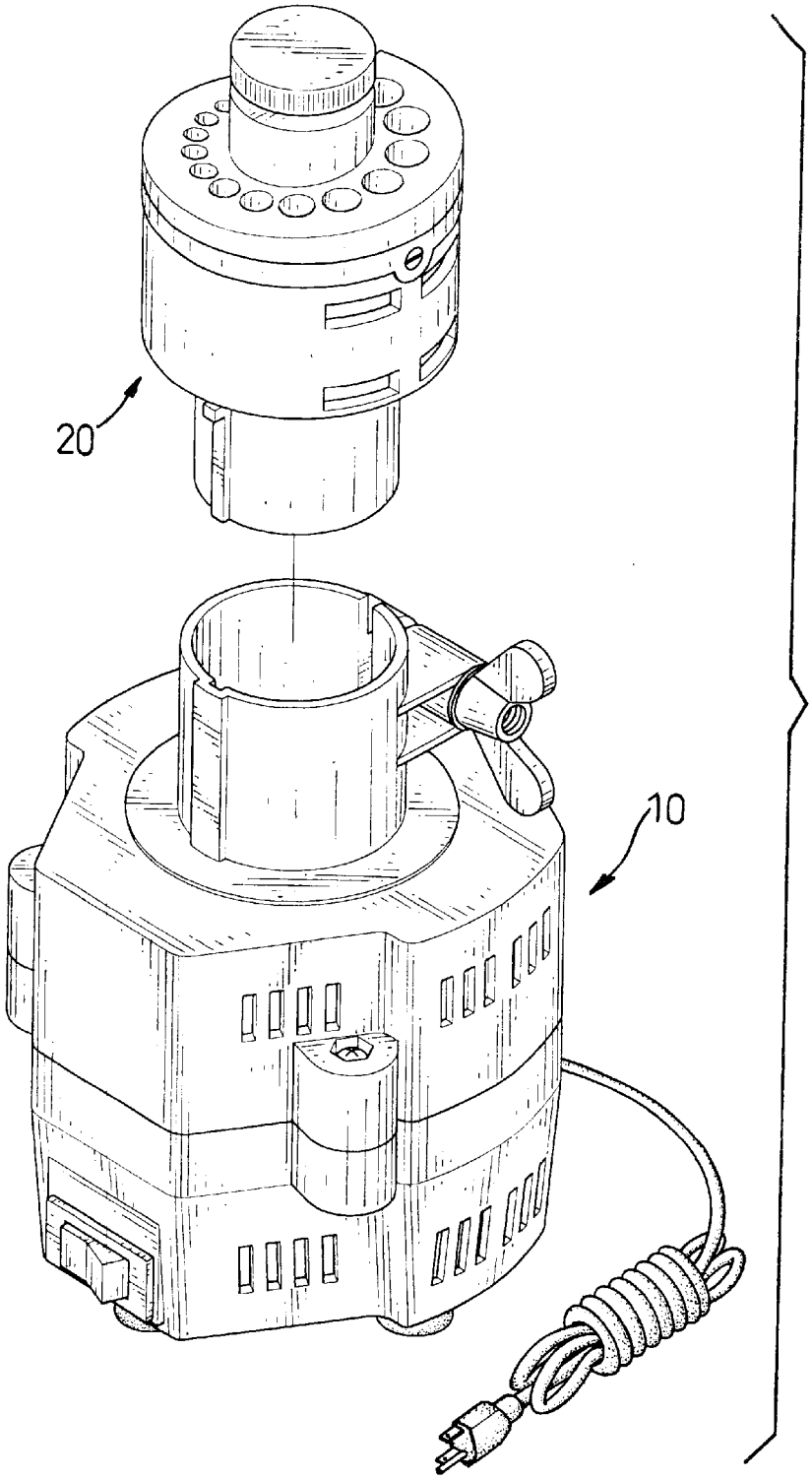
FIG. 1 is a partially exploded perspective view of a grill bit sharpener in accordance with the present invention.
Figure 2:
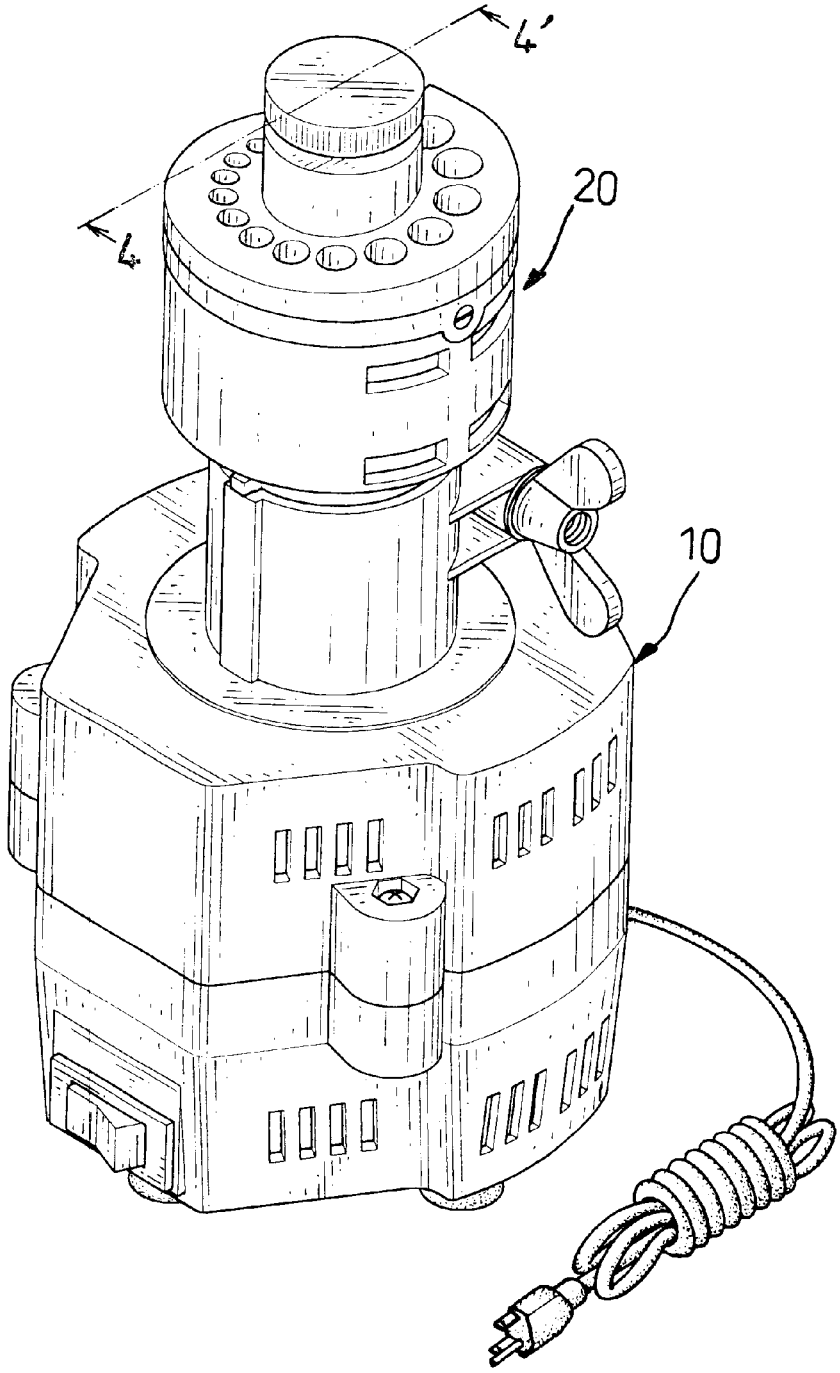
FIG. 2 is a perspective view of the grill bit sharpener in FIG. 1.

With reference to FIGS. 1 and 2, a drill bit sharpener in accordance with the present invention comprises a motor assembly (10) and a drill bit grinding assembly (20). The motor assembly (10) drives the drill bit grinding assembly (20), and the drill bit grinding assembly (20) is attached to the motor assembly (10) for operation.

Figure 3:
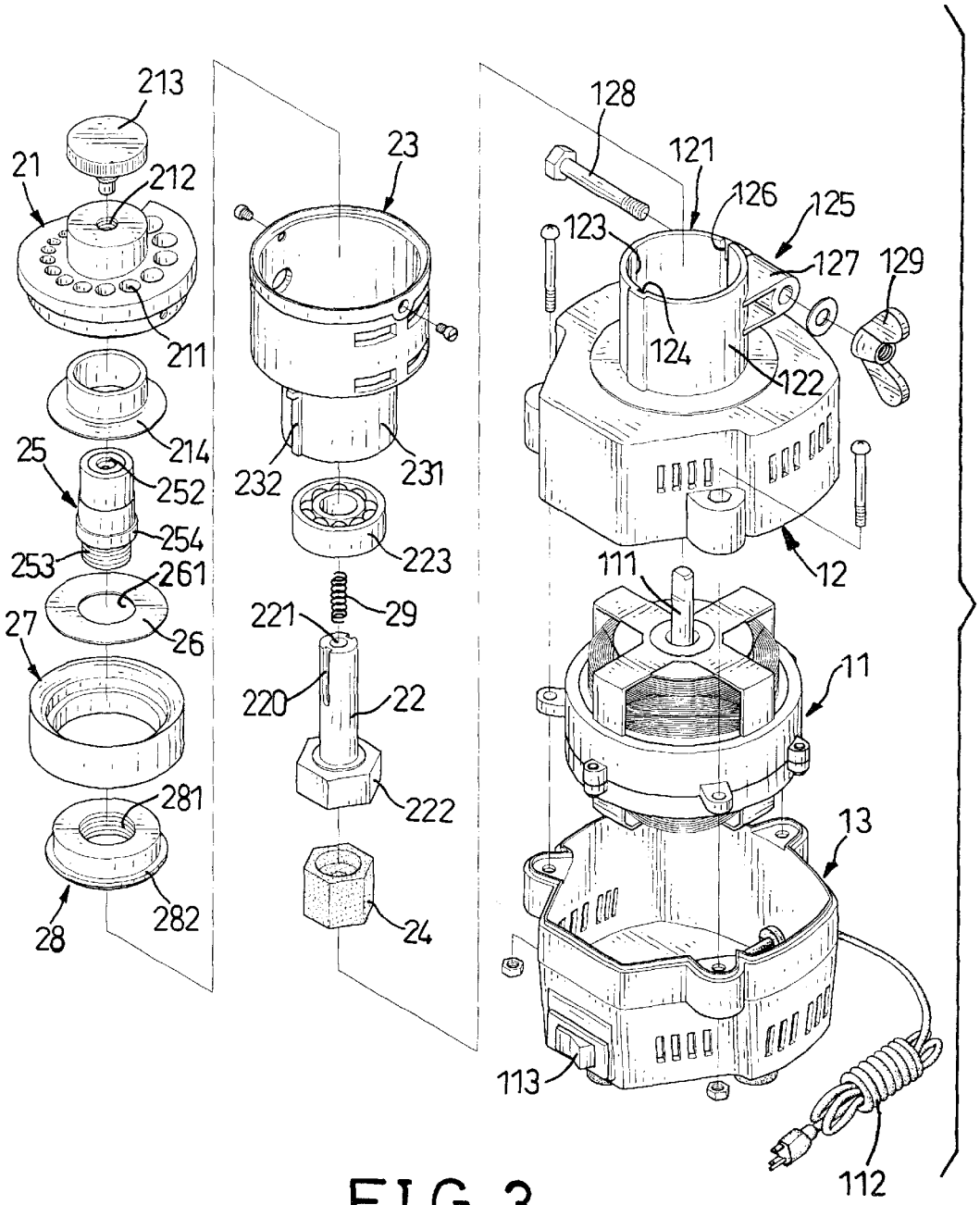
FIG. 3 is an exploded, perspective view of the grill bit sharpener in FIG. 1.
Figure 4:
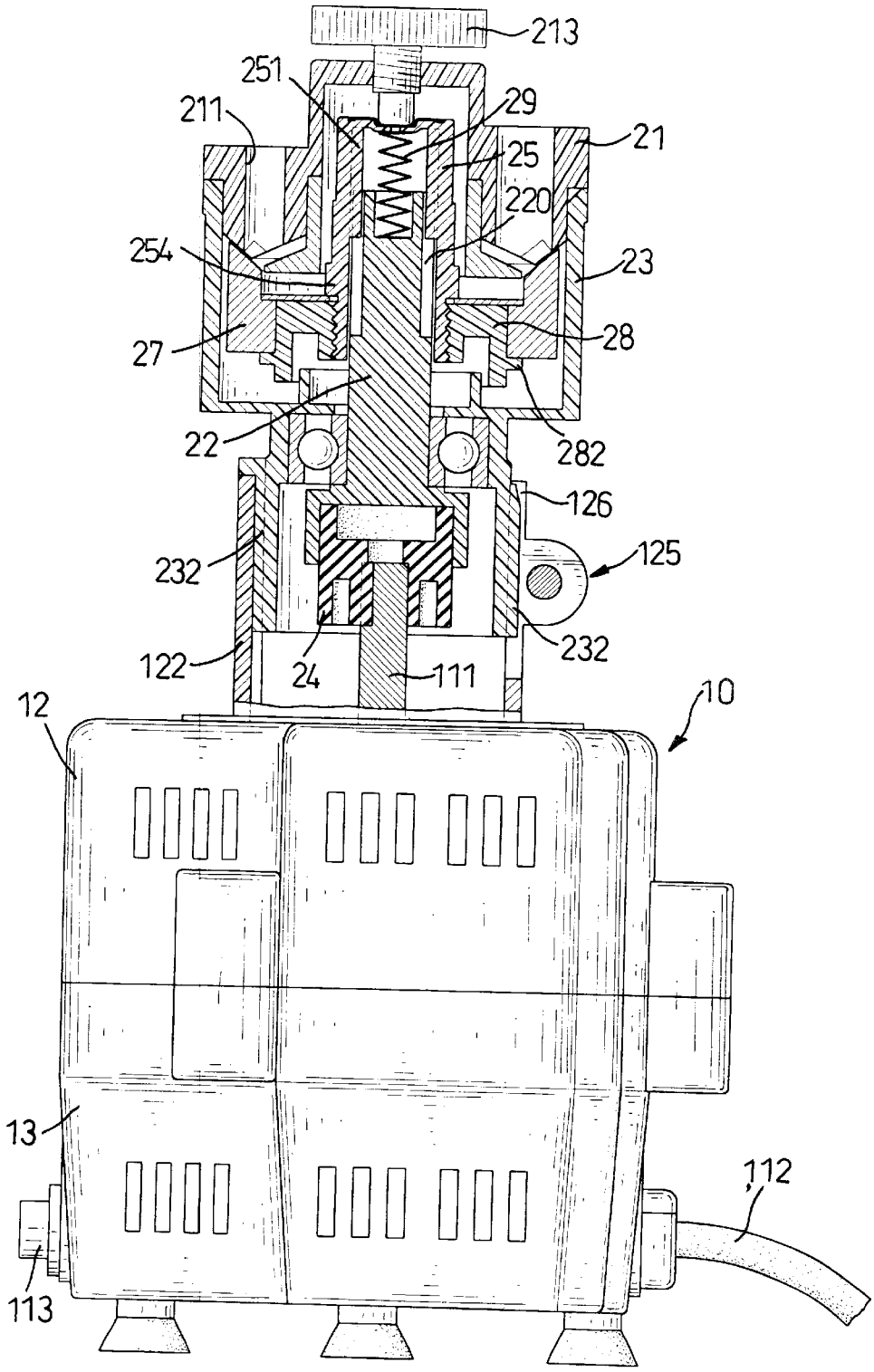
FIG. 4 is a front plan view in partial section of the grill bit sharpener along line 4–4' in FIG. 2.

With further reference to FIGS. 3 and 4, the motor assembly (10) comprises a motor (11), an upper housing (12) and a lower housing (13). The motor (11) has a drive shaft (111) mounted vertically in the motor (11). The drive shaft (111) has a keyed upper end (not numbered) and a lower end. The motor (11) is electrically connected to a power cord (112) and a switch (113). The power cord (112) is adapted to connect to an electrical outlet (not shown) and transmits a current to the motor (11) to rotate the drive shaft (111) when the switch (113) is turned on.

The motor (11) is encased by the upper and lower housings (12, 13) and is mounted between the upper and lower housings (12, 13). The upper housing (12) has a top (not numbered) and a grinder assembly seat (121) and is securely attached to the lower housing (13). The grinder assembly seat (121) is formed integrally with the top of the upper housing (12) and has a center. A hole (not numbered) is defined through the top of the upper housing (12) at the center of the grinder assembly seat (121), and the upper end of the drive shaft (111) of the motor (11) extends through the hole.

The grinder assembly seat (121) is a hollow cylinder that has a sidewall (122) and an inner opening (123) with a diameter. A keyway (124) is defined vertically in the sidewall (122), and a clamping device (125) is mounted to the sidewall (122). The clamping device (125) has a vertical slot (126) and two blocks (127). The blocks (127) are attached to the sidewall (122) on opposite sides of the slot (126). Each block (127) has a lateral through hole (not numbered). A bolt (128) with a hexagonal head and a threaded shaft passes through both lateral through holes. A wing nut (129) is screwed onto the threaded shaft of the bolt (128), which squeezes the blocks (127) toward each other. The diameter of the inner opening (123) reduces as the wing nut (129) is tightened on the bolt (128).

The drill bit grinding assembly (20) includes a driven assembly, a sharpener housing (23), a grinding wheel assembly and a bit guide assembly. The driven assembly is attached to the drive shaft (111) of the motor assembly (10) and rotates the grinding wheel assembly. The bit guide assembly is mounted in the driven assembly to hold and correctly position a drill bit when grinding the drill bit.

The driven assembly includes a spindle (22) and a connector (24). The spindle (22) has a vertical axis, an outer surface (not numbered), an upper end and a lower end and is rotatably mounted in a bearing (223) mounted in the sharpener housing (23). Two keyways (220) are defined on diametrically opposite outer surface of the upper end of the spindle (22). The keyways (220) are parallel to the axis of the spindle (22). A spring hole (221) is defined axially in the upper end of the spindle (22) between the two keyways (220). A hollow connecting seat (222) with multiple internal facets is formed at the lower end of the spindle (22). The connector (24) has multiple external facets corresponding to the internal facets in the connecting seat (222) and an internal keyhole (not numbered) corresponding to the keyed upper end of the drive shaft (111). The connector (24) is mounted in the connecting seat (222) and on the keyed end of the drive shaft (111) of the motor (11) so the drive shaft (111) can rotate the spindle (22).

The sharpener housing (23) is a hollow cylinder with an open top (not numbered) and a partially open bottom (not numbered). An internal sleeve (231) is formed at the bottom of the sharpener housing (23) and is mounted in the upper housing (12) of the grinder assembly seat (121). Two keys (232) are formed vertically on the sleeve (231) and correspond to the keyway (124) and the slot (126) in the sidewall (122) of the grinder assembly seat (121). The keys (232) are slightly narrower than the width of the keyway (124) and the slot (126). When the sleeve (231) is inserted into the grinder assembly seat (121), the two keys (232) are held in the keyway (124) and the slot (126), respectively. Because the width of the key (232) is smaller than the width of the slot (126), a user can turn the wing nut (129) and draw the two blocks (127) together to reduce the diameter of the opening (123) of the grinder assembly seat (121) to securely clamp the sleeve (231). The sharpener housing (23) can be firmly held in the grinder assembly seat (123).

The grinding wheel assembly includes a hollow adjustment shaft (25), an attachment adapter (26), a grinding wheel (27) and a wheel base (28). The adjustment shaft (25) has an inner space, a closed upper end and an open lower end. The adjustment shaft (25) is mounted over the upper end of the spindle (22) with the spindle (22) partly mounted in the inner space of the adjustment shaft (25). A spring (29) is mounted in the spring hole (221) in the spindle (22) between the spindle (22) and the adjustment shaft (25). Two keys (251) are formed in the inner space of the adjustment shaft (25) at the upper end and are slidably mounted in the two keyways (220) at the upper end of the spindle (22). Consequently, the adjustment shaft (25) will not rotate relative to the spindle (22) and is rotated by the spindle (22).

A recess (252) is defined axially in the closed end of the adjustment shaft (25). A lip (254) is defined around the adjustment shaft (25). An external thread (253) is defined on the adjustment shaft (25) between the lip (254) and the open lower end of the adjustment shaft (25). The attachment adapter (26) has a central hole (261) through which the open lower end of the adjustment shaft (25) passes abuts the lip (254) of the adjustment shaft (25). The wheel base (28) has a central threaded hole (281) and an exterior lip (282). The external thread (253) around the open lower end of the adjustment shaft (25) screws into the central threaded hole (281) in the wheel base (28). The grinding wheel (27) is securely squeezed and held between the attachment adapter (26) and the exterior lip (282) of the wheel base (28) when the external tread (253) is screwed into the central threaded hole (281) of the wheel base (28). So the grinding wheel (27) will rotate with the adjustment shaft (27).

The bit guide assembly is mounted on the open top of the sharpener housing (23) and includes a guide block (21), an adjusting screw (213) and a bit limit ring (214). The guide block (21) has a top, a bottom and a center through which passes a vertical axis. A vertical protrusion (not numbered) is formed at the center of the guide block (21) and a spiral inclined surface (not numbered) is formed around the protrusion on the top. A threaded hole (212) is de fined in the center of the protrusion through the guide block (21) along the axis of the guide block (21). The adjusting screw (213) has two ends. A disk (not numbered) is attached to one end, and the other end screws into the threaded hole (212) and extends out of the threaded hole (212) and presses against the recess (252) in the closed upper end of the adjustment shaft (25). Multiple bit guide holes (211) are defined in the spiral inclined surface of the guide block (21) through the guide block (21). The bit guide holes (211) correspond to the grinding wheel (27) so a drill bit can pass through one of the guide holes (211) and abut the grinding wheel (27). The bit limit ring (214) is attached to the bottom of the guide block (21) and partly covers the bottom of each bit guide hole (211).

Figure 5:
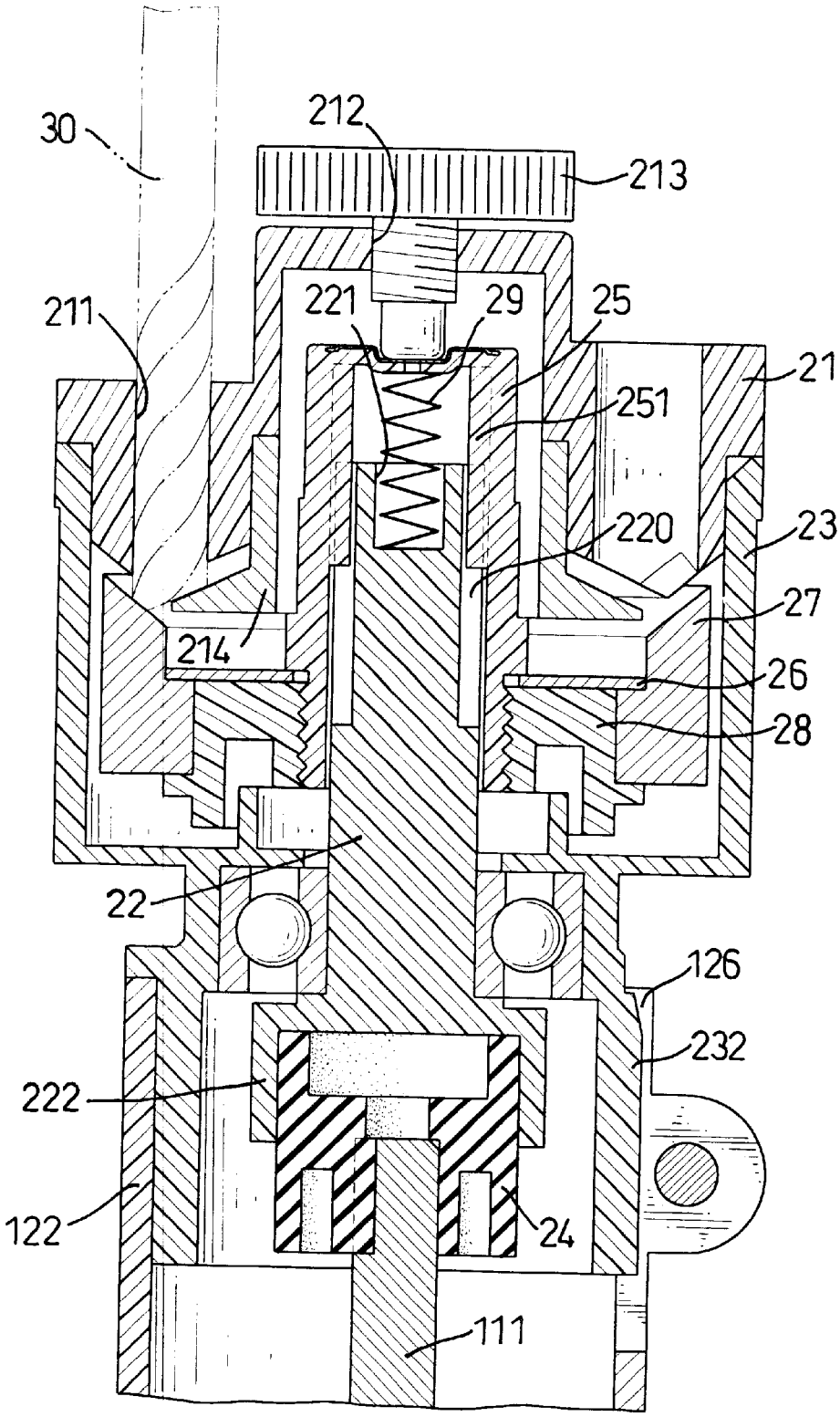
FIG. 5 is an enlarged, operational front plan view in partial section along line 4–4' in FIG. 2 showing a grill bit being sharpened by the sharpener.

With reference to FIG. 5. the drive shaft (111) rotates the grinding wheel (27) as previously described. One end of a drill bit (30) passes through one of the bit guide holes (211). The end of the drill bit (30) has diametrically opposite sides. One side abuts the bit limit ring (214), and the other side contacts the rotating grinding wheel (27) to grind and sharpen the end of the drill bit (30) to the required cutting edge and relief angle. The bit limit ring (214) supports the end of the drill bit (30) during sharpening process so the user can hold the drill bit (30) easily.

With the grinding wheel (27) in position to sharpen drill bits (30), the portion of the grinding wheel (27) in contact with the drill bits (30) gradually wears down. To adjust the position of the grinding wheel (27), the disk on the adjusting screw (213) is turned to screw the adjusting screw (213) into or out of the threaded hole (212). When the adjusting screw (213) is screwed out of the threaded hole (212), the spring (29) compressed between the spindle (22) and the adjustment shaft (25) pushes the adjustment shaft (25) and the attached grinding wheel (27) up. When the adjustment screw (213) is screwed into the threaded hole (212), the adjustment shaft (25) and the attached grinding wheel (27) will move down. Consequently, the position of the grinding wheel (27) is changeable and adjustable.

The present invention has following advantages:

1. Saves time:

The position of the grinding wheel (27) is adjustable so the drill bit (30) can be sharpened quickly to the proper shape and angle, which will help the user to efficiently make holes of the right size. Furthermore, the user can drill holes faster with less power.

2. Portable and safe:

The drill bit sharpener is small and can be carried easily. Furthermore, the sharpener can be assembled quickly for operation. Moreover, the rotating grinding wheel (27) is completely shielded in the sharpener housing (23) and covered by the guide block (21), which completely obviates the possibility of injury to the user by the grinding wheel (27). Consequently, the drill bit sharpener is safe.

3. Convenient use:

The guide holes (211) in the guide block (21) are design ed to guide and position the drill bit (30) well when sharpening. Inserting the drill bit (30) into the appropriate guide hole (211) to sharpen the drill bit (30) is very convenient, and extends the useful life of the drill bit (30) thereby saving time and money.

Even though numerous characteristics and advantages of the present invention have been set forth in the foregoing description, together with details of the structure and function of the invention, the disclosure is illustrative only and changes may be made in detail, especially in matters of shape, size, and arrangement of parts within the principles of the invention to the full extent indicated by the broad general meaning of the terms in which the appended claims are expressed.

What is claimed is:

1. A drill bit sharpener comprising:

a motor assembly comprising a motor with a drive shaft, the motor electrically connected to a power cord and the drive shaft having an upper keyed end that extends vertically out of the motor;

an upper housing having a top with a hole, a clamping device and a grinder assembly seat, the grinder assembly seat formed on the top of the upper housing and having a sidewall, a center and an inner opening with a diameter, the hole defined in the top of the upper housing at the center of the grinder assembly seat and the upper keyed end of the drive shaft passing through the hole; the clamping device attached to the sidewall and adapted to adjust the diameter of the inner opening; and a lower housing attached to the upper housing to house the motor; and a drill bit grinding assembly comprising a hollow sharpener housing having a open top and a bottom, a sleeve formed at the bottom of the sharpener housing and the sleeve mounted in the grinder assembly seat of the upper housing;

a driven assembly comprising a spindle having an upper end and a lower end and rotatably mounted in the sharpener housing with the lower end attached to the upper keyed end of the drive shaft and a spring mounted axially to the spindle at the upper end;

a grinding wheel assembly comprising a hollow adjustment shaft has an inner space, a closed upper end and an open lower end, and mounted over the spring on the upper end of the spindle; and a grinding wheel securely attached to the adjustment shaft; and a bit guide assembly comprising a guide block mounted in the open top of the sharpener housing, and having a top, a bottom and a center through which passes a vertical axis, a vertical protrusion formed at the center of the guide block, a threaded hole defined in the protrusion at the center of and through the guide block, multiple bit guide holes defined in the top of the guide block and through the guide block; and an adjusting screw has two ends with a disk attached to one end and the other end screwed into and extending out of the threaded hole to press against the adjustment shaft;

wherein the guide holes correspond to the grinding wheel so a drill bit can pass through one of the bit guide holes and abut the grinding wheel when the adjustment shaft is rotated.

2. The drill bit sharpener as claimed in claim 1, wherein the clamping device includes a vertical slot, two blocks, a bolt and a wing nut, the blocks are attached to the sidewall of the grinder assembly seat, the slot is defined vertically in the sidewall of the grinder assembly seat between the two blocks, the bolt has two ends with a hexagonal head on one end and an external thread on the other end, each block has a lateral through hole through which the threaded end of the bolt passes and the wing nut is screwed onto the threaded end of the bolt to squeeze the blocks together and reduce the diameter of the opening of the grinder assembly seat.

3. The drill bit sharpener as claimed in claim 2, wherein the spindle is rotatably mounted in a bearing mounted in the sharpener housing and has an outer surface, a vertical axis, an upper end and a lower end, two keyways are defined on diametrically opposite outer surface of the upper end of the spindle, and the opposing keyways are parallel to the vertical axis of the spindle, and two keys are formed in the inner space of the adjustment shaft at the closed upper end and are slidably mounted in the two keyways at the upper end of the spindle.

4. The drill bit sharpener as claimed in claim 3, wherein the grinding wheel assembly further comprises a lip defined around the adjustment shaft, a thread defined on the adjustment shaft between the lip and the open lower end of the adjustment shaft;

an attachment adapter with a central hole through which the open lower end of the adjustment shaft passes is attached to the adjustment shaft and abuts the lip of the adjustment shaft; and a wheel base having a threaded hole and a exterior lip, the thread of the adjustment shaft screws into the threaded hole, and the grinding wheel is squeezed and held securely between the attachment adapter and the exterior lip of the wheel base.

5. The drill bit sharpener as claimed in claim 4, wherein a recess is defined axially in the closed upper end of the adjustment shaft and is adapted to receive the end of the adjusting screw.

6. The drill bit sharpener as claimed in claim 5, wherein a keyway is defined vertically in the sidewall of the grinder assembly seat, and two keys are formed on the sleeve of the sharpener housing and the keys correspond to the keyway of the sidewall and the slot of the clamping device, respectively.

7. The drill bit sharpener as claimed in claim 6, wherein a spring hole is defined axially in the upper end of the spindle to partially receive the spring; a multi-faceted hollow connecting seat is formed at the lower end of the spindle, a multi-faceted connector is mounted in the connecting seat, and attached to the upper keyed end of the drive shaft of the motor so the drive shaft can rotate the spindle.

8. The drill bit sharpener as claimed in claim 7, wherein a bit limit ring is attached to the bottom of the guide block and partly covers each bit guide hole at the bottom of the guide block.

9. The drill bit sharpener as claimed in claim 3, wherein a recess is defined axially in the closed upper end of the adjustment shaft and is adapted to receive the end of the adjusting screw.

10. The drill bit sharpener as claimed in claim 9, wherein a keyway is defined vertically in the sidewall of the grinder assembly seat, and two keys are formed on the sleeve of the sharpener housing and the keys correspond to the keyway of the sidewall and the slot of the clamping device, respectively.

11. The drill bit sharpener as claimed in claim 10, wherein a spring hole is defined axially in the upper end of the spindle to partially receive the spring; a multi-faceted hollow connecting seat is formed at the lower end of the spindle, a multi-faceted connector is mounted in the connecting seat, and attached to the upper keyed end of the drive shaft of the motor so the drive shaft can rotate the spindle.

12. The drill bit sharpener as claimed in claim 11, wherein a bit limit ring is attached to the bottom of the guide block and partly covers each bit guide hole at the bottom of the guide block.

13. The drill bit sharpener as claimed in claim 8, wherein a spiral inclined surface is formed around the protrusion on the top of the guide block, and the bit guide holes are defined in the spiral inclined surface of the guide block through the guide block.

* * * * *